United States Patent [19]

Steinert

[11] Patent Number: 4,873,999

[45] Date of Patent: Oct. 17, 1989

[54] CIGARETTE HOLDER

[76] Inventor: Rosa M. Steinert, 103 Glenmore Ave., Central Islip, N.Y. 11722

[21] Appl. No.: 272,798

[22] Filed: Nov. 18, 1988

[51] Int. Cl.[4] ..... A24F 13/08; A24F 13/12

[52] U.S. Cl. ..... 131/259; 131/258

[58] Field of Search ..... 131/258, 259, 257, 188

[56] References Cited

U.S. PATENT DOCUMENTS

| | | | |
|---|---|---|---|
| 1,345,356 | 7/1920 | Dunhill . | |
| 1,517,142 | 11/1924 | Allman . | |
| 1,862,679 | 6/1932 | Holsman . | |
| 1,904,903 | 4/1933 | Sweet | 131/259 |
| 2,626,614 | 1/1953 | Hamer . | |
| 3,797,644 | 3/1974 | Shaw . | |

FOREIGN PATENT DOCUMENTS

| | | | |
|---|---|---|---|
| 0016031 | of 1899 | United Kingdom | 131/259 |
| 0533757 | 2/1941 | United Kingdom | 131/259 |

*Primary Examiner*—V. Millin

*Attorney, Agent, or Firm*—Jerry T. Kearns

[57] ABSTRACT

A cigarette holder has an elongated cylindrical stem having a flattened handle portion at one end and a generally cylindrical holding element at an opposite end. A cylindrical passage is formed centrally through the holding element and has a longitudinal axis extending generally perpendicular to the stem. The holding element may be provided wiht ornamentation for providing an attractive appearance. In a second embodiment, a transverse aperture extends through a cylindrical side wall of the holding element and intersects the cylindrical passage. A sharpened tapered inner end of the retaining pin is biased by a coil spring into engagement with a cigarette inserted through the central passage. The cigarette is released by manually retracting the retaining pin by grasping an enlarged exterior head portion of the pin.

3 Claims, 2 Drawing Sheets

CIGARETTE HOLDER

BACKGROUND OF THE INVENTION

1. Field of the Invention

The present invention relates to cigarette holders, and more particularly pertains to a new and improved cigarette holder which provides an ornamented cylindrical holding element secured at one end of an elongated stem. Conventional forms of cigarette holders do not adequately secure a cigarette within the holder. Additionally, conventional holders are not suitable for use with cigarettes having various different diameters. In order to overcome this problem, the present invention provides a cigarette holder with a retaining pin for securing cigarettes within the holder.

2. Description of the Prior Art

Various types of cigarette holders are known in the prior art. A typical example of such a cigarette holder is to be found in U.S. Pat. No. 1,345,356, which issued to A. Dunhill on July 6, 1920. This patent discloses a telescoping holder which collapses into a compact size when not in use. A socket on an end portion of the telescoping stem is frictionally engaged with the end of a cigarette. U.S. Pat. No. 1,517,142, which issued to A. Allman on Nov. 25, 1924, discloses a cigarette holder and extinguisher which includes an elongated hollow stem having a central cylindrical passage extending generally parallel therewith. The cigarette may be enclosed within the stem and a cap inserted thereover to smother the cigarette. U.S. Pat. No. 1,862,679, which issued to J. Holsman on June 14, 1932, discloses a short cylindrical jacket for reception around a portion of a cigarette to provide a gripping surface. U.S. Pat. No. 2,626,614, which issued to F. Hamer on Jan. 27, 1953, discloses a combined cigarette holder, casing and stand which is foldable between storage and operative positions. A hollow stem has a central cylindrical passage for insertion of an end portion of a cigarette. U.S. Pat. No. 3,797,644, which issued to H. Shaw on Mar. 19, 1974, discloses a cigarette holder filter which includes a cigarette receiving socket at one end and a mouthpiece at the other end. The interior of the holder includes a fibrous filtering material impregnated with water.

While the above mentioned devices are suited for their intended usage, none of these devices disclose a cigarette holder having an elongated stem with a flattened portion at one end and a cylindrical holding element at an opposite end provided with a spring bias retaining pin for retaining a cigarette within a cylindrical passage formed therethrough. Inasmuch as the art is relatively crowded with respect to these various types of cigarette holders, it can be appreciated that there is a continuing need for and interest in improvements to such cigarette holders, and in this respect, the present invention addresses this need and interest.

SUMMARY OF THE INVENTION

In view of the foregoing disadvantages inherent in the known types of cigarette holders now present in the prior art, the present invention provides an improved cigarette holder. As such, the general purpose of the present invention, which will be described subsequently in greater detail, is to provide a new and improved cigarette holder which has all the advantages of the prior art cigarette holders and none of the disadvantages.

To attain this, representative embodiments of the concepts of the present invention are illustrated in the drawings and make use of an elongated cylindrical stem having a flattened handle portion at one end and a generally cylindrical holding element at an opposite end. A cylindrical passage is formed centrally through the holding element and has a longitudinal axis extending generally perpendicular to the stem. The holding element may be provided with ornamentation for providing an attractive appearance. In a second embodiment, a transverse aperture extends through a cylindrical side wall of the holding element and intersects the cylindrical passage. A sharpened tapered inner end of the retaining pin is biased by a coil spring into engagement with a cigarette inserted through the central passage. The cigarette is released by manually retracting the retaining pin by grasping an enlarged exterior head portion of the pin.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cigarette holder which has all the advantages of the prior art cigarette holders and none of the disadvantages.

It is another object of the present invention to provide a new and improved cigarette holder which may be easily and efficiently manufactured and marketed.

It is a further object of the present invention to provide a new and improved cigarette holder which is of a durable and reliable construction.

An even further object of the present invention is to provide a new and improved cigarette holder which is susceptible of a low cost of manufacture with regard to both materials and labor, and which accordingly is then susceptible of low prices of sale to the consuming public, thereby making such cigarette holders economically available to the buying public.

Still yet another object of the present invention is to provide a new and improved cigarette holder which provides in the apparatuses and methods of the prior art some of the advantages thereof, while simultaneously overcoming some of the disadvantages normally associated therewith.

Still another object of the present invention is to provide a new and improved cigarette holder having an attractive ornamental appearance.

Yet another object of the present invention is to provide a new and improved cigarette holder which utilizes an elongated stem having a flattened handle portion for enabling convenient handling of a cigarette.

Even still another object of the present invention is to provide a new and improved cigarette holder adapted for use with various different diameters of cigarettes and having a spring biased retaining pin for retaining cigarettes therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
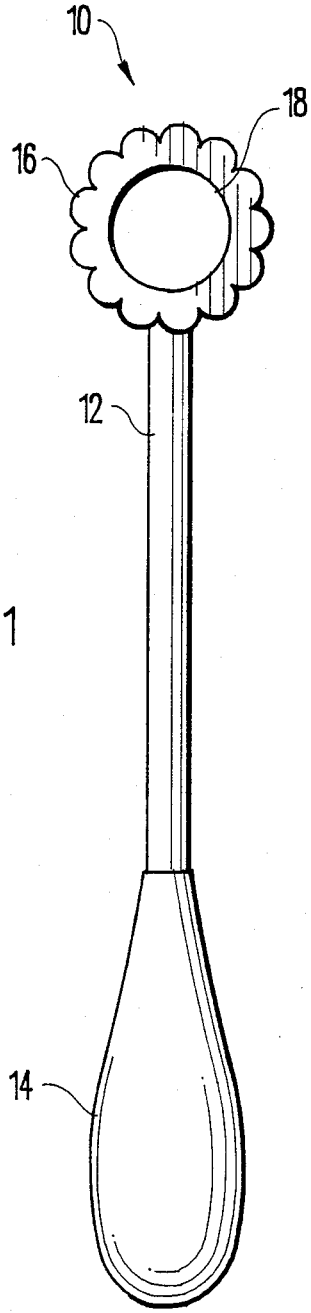
FIG. 1 is a front view of a cigarette holder according to a first embodiment of the present invention.

With reference now to the drawings, and in particular to FIG. 1 thereof, a new and improved cigarette holder embodying the principles and concepts of the present invention and generally designated by the reference numeral 10 will be described.

More specifically, it will be noted that the first embodiment 10 of the invention includes an elongated cylindrical stem 12 having a flattened enlarged handle portion 14 at one end and a generally cylindrical holding element 16 at an opposite end. The holding element 16 is provided with exterior ornamentation which may take the form of the illustrated flower exterior scalloping or may include various other sculptured effects and engravings. A cylindrical passage 18 is formed centrally through the holding element 16 and is dimensioned for frictional engagement with a standard diameter inserted cigarette.

Figure 2:
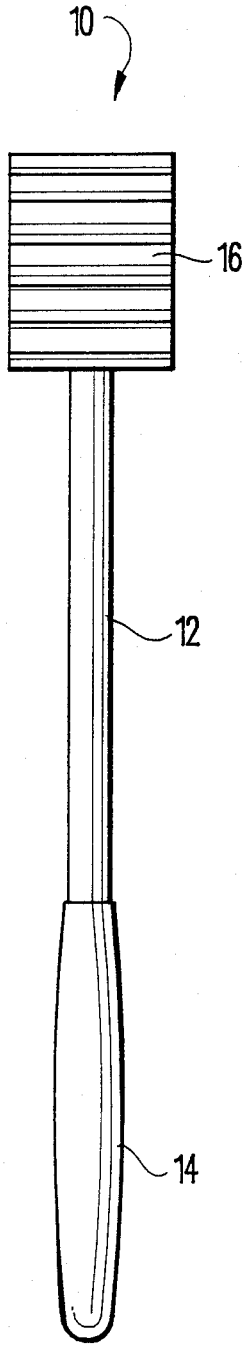
FIG. 2 is a side view of a cigarette holder according to the first embodiment of the present invention.

FIG. 2 provides a side view of the cigarette holder. In the use of the cigarette holder of the first embodiment 10 of the present invention, a cigarette is inserted through the passage 18 and is frictionally retained therein. A smoker then holds the device between a thumb and forefinger utilizing the flattened handle portion 14.

Figure 3:
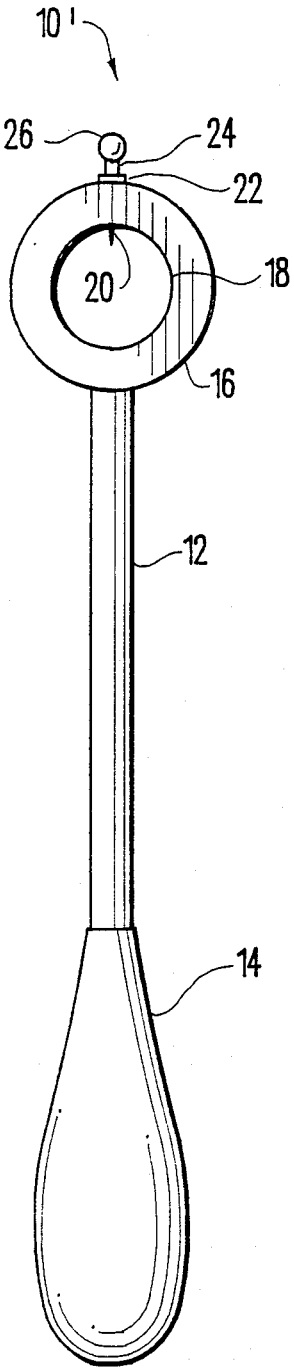
FIG. 3 is a front view of a cigarette holder according to a second embodiment of the present invention.

In FIG. 3, a slightly modified form of cigarette holder 10' according to the second embodiment of the present invention is illustrated. The holder 10' is substantially similar to the first embodiment 10, and includes an elongated cylindrical stem 12 having a flattened handle portion 14 formed at one end and a generally cylindrical holding element 16 formed at an opposite end. A cylindrical passage 18 is formed centrally through the holding element 16 and is dimensioned with a diameter slightly larger than the largest standard sized diameter of a cigarette. A tapered sharpened end portion 20 of a retaining pin 4 extends into the cylindrical passage 18, and is adapted for engagement with an inserted cigarette. A cup-shaped boss 22 is formed exteriorly on a cylindrical side wall of the holding element 16 and surrounds the retaining pin 24. An enlarged head portion 26 is provided for manipulation of the retaining pin 24 and is dimensioned to prevent insertion through the boss 22.

Figure 4:
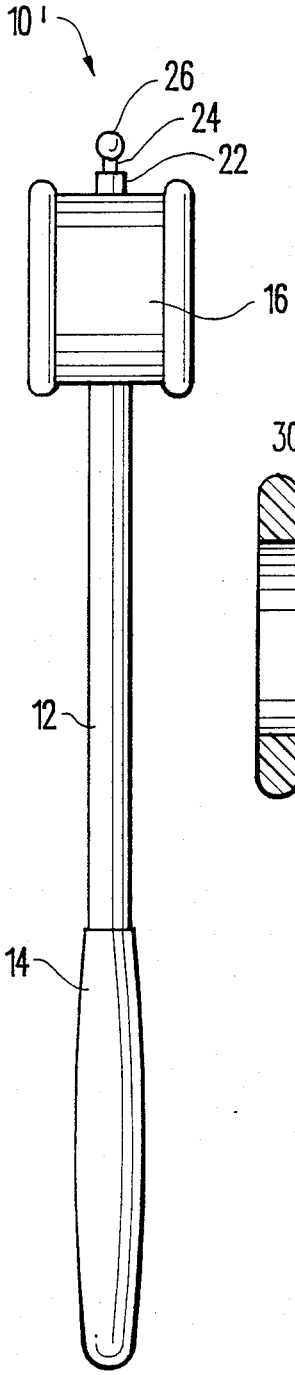
FIG. 4 is a side view of a cigarette holder according to the second embodiment of the present invention.

FIG. 4 provides a side view of the cigarette holder 10'.

Figure 5:
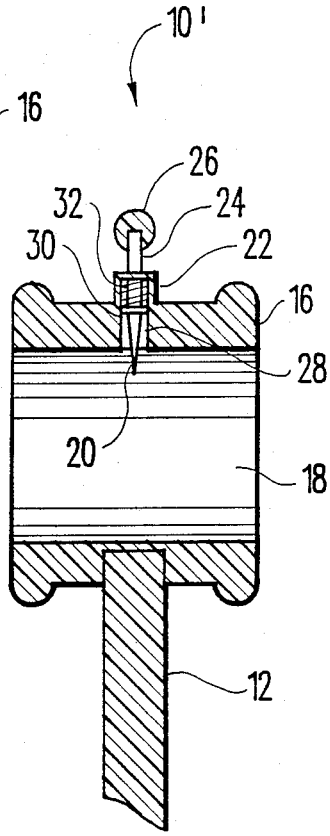
FIG. 5 is a partial cross sectional detail view, illustrating the retaining pin assembly of the cigarette holder according to the second embodiment of the present invention.

As shown in the enlarged cross sectional view of Figure 5, the cup-shaped retaining boss 22 is aligned with a transverse aperture 28, which extends in alignment with the longitudinal axis of the stem 12. The retaining pin 24 is provided with a radially extending flange 30 which has a diameter slightly less than the diameter of the transverse aperture 28, but greater than the aperture formed through the top wall of the retaining boss 22. Thus, the retaining flange 30 in combination with the exterior enlarged head portion 26 retains the pin 24 within the aperture 28. A coil spring 32 surrounds the pin 24 and has a first end in abutment with the retaining flange 30 and a second opposite end in abutment with an interior top wall portion of the retaining boss 22. Thus, the spring 32 biases the sharpened end portion 20 of the retaining pin 24 toward the central portion of the cylindrical passage 18. In use, different cigarettes of different sized diameters may be inserted within the passage 18 by retracting the retaining pin 24 by grasping the enlarged head portion 26. Upon insertion of the cigarette within the passage 18, the enlarged head portion 26 is released, allowing engagement of the sharpened end portion 20 of the retaining pin 24 with the cigarette. By this construction, various different diameter sizes of cigarettes may be secured.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cigarette holder, comprising:

an elongated cylindrical stem;

a flattened handle portion at one end of said stem;

a generally cylindrical holding element at an opposite end of said stem;

a cylindrical passage formed centrally through said holding element, a longitudinal axis of said passage extending generally perpendicular to said stem;

a transverse aperture extending through a cylindrical side wall of said holding element and intersecting said cylindrical passage, a longitudinal axis of said transverse aperture in alignment with said stem;

a cup-shaped retaining boss on an exterior portion of said holding element, surrounding said transverse aperture, said box having a reduced diameter aperture in alignment with said transverse aperture;

an elongated retaining pin having a sharpened tapered end portion inserted into said transverse aperture;

an enlarged head portion on an outer end of said retaining pin, exterior of said boss;

a radial flange on an intermediate portion of said retaining pin, said radial flange having a diameter slightly less than said transverse aperture and greater than said boss aperture;

and a coil spring surrounding said retaining pin and having a first end in abutment with said radial flange and an opposite end in abutment with an interior top wall of said boss, said spring biasing said sharpened tapered end portion of said retaining pin toward said cylindrical passage.

2. A cigarette holder, comprising:

an elongated cylindrical stem;

a flattened handle portion at one end of said stem;

a generally cylindrical holding element at an opposite end of said stem;

a cylindrical passage formed centrally through said holding element, a longitudinal axis of said passage extending generally perpendicular to said stem;

retaining pin means in said holding element for selective engagement with a cigarette inserted in said cylindrical passage;

and spring means for biasing said retaining pin means into engagement with a cigarette.

3. The cigarette holder of claim 2, further comprising ornamentation on said holding element.

* * * * *